United States Patent [19]

Marker

[11] 3,930,661

[45] Jan. 6, 1976

[54] SAFETY SKI-BINDING

[76] Inventor: Hannes Marker, Hauptstrabe 51-53, 81 Garmisch-Partenkirchen, Germany

[22] Filed: Jan. 9, 1975

[21] Appl. No.: 539,805

[30] Foreign Application Priority Data

Jan. 15, 1974 Germany ..... 2401808

[52] U.S. Cl. ..... 280/11.35 K; 280/11.35 T

[51] Int. Cl.[2] ..... A63C 9/08

[58] Field of Search 280/11.35 K, 11.35 T, 11.35 C

[56] References Cited

UNITED STATES PATENTS

| | | | |
|---|---|---|---|
| 3,801,121 | 4/1974 | Mimeur | 280/11.35 T |
| 3,822,070 | 7/1974 | Solomon | 280/11.35 K |
| 3,854,744 | 12/1974 | Solomon | 280/11.35 T |

*Primary Examiner*—Robert R. Song
*Attorney, Agent, or Firm*—Fleit & Jacobson

[57] ABSTRACT

In a safety ski-binding comprising an elongated sole plate for supporting a ski boot, sole depressors provided on the sole plate for releasably retaining the boot thereon and mounting means for holding the sole plate to the ski except on the occurrence of an overload, the sole plate is provided with at least one transverse horizontal pivotal axis disposed in the region supporting the ball of the boot so that the sole plate can bend to an upwardly concave shape and adapt itself to a corresponding curvature of the ski during use. The sole plate may be made in two or more parts which are hinged to one another, in which case the or each hinge line constitutes the respective pivotal axis, or at least the ball-supporting region of the sole plate may comprise a thin and flexible sheet having a plurality of juxtaposed transverse members secured to its underside.

4 Claims, 3 Drawing Figures

SAFETY SKI-BINDING

The invention relates to a safety ski-binding in which the connection between a ski boot and a ski is effected by a sole plate that is provided with front and rear sole depressors, the boot being supported on the sole plate so that it can be only intentionally released. The binding further comprises mounting means for the sole plate, which mounting means are adapted to be secured to the ski and are effective to release the sole plate from the ski in the vertical and/or horizontal direction when an overload occurs.

A particular purpose of such a ski-binding is to enable a lightweight ski boot with flexible sole to be used without sacrificing a really secure connection between the foot and the ski that is necessary to obtain good ski control.

However, a disadvantage of such a ski binding is that the sole plate, which extends along the entire length of the boot, is completely rigid. Because of this it is possible for the sole plate to become jammed between the points at which it is mounted on the ski by the mounting means if, for example, the ski happens to flex concave upwardly as it passes over a hollow. At this instant the retaining forces acting on the ski may increase to such an extent that, if some dangerous rotational movement also takes place, the sole plate may not become free from the ski, thereby increasing the danger of a rotary fracture of the shin bone. On the other hand, during normal skiing the necessary retaining forces are not often approached having regard to the required safety factor.

Another disadvantage of a rigid sole plate is its unfavourable influence on the elasticity of the ski which is reinforced along the length covered by the sole plate.

It is an object of the present invention to avoid the aforementioned disadvantages of safety ski-bindings without unduly complicating their construction or making them more expensive, so that the inherent advantage of a sole plate can be utilised to an optimum degree.

According to the invention, a safety ski-binding comprises an elongated sole plate adapted to be fitted on a ski to support a ski boot, front and rear sole depressors provided on the sole plate for retaining the boot thereon except when it is to be intentionally released, and mounting means for the sole plate effective to release the latter from the ski in a vertical and/or horizontal direction on the occurrence of overload, wherein the sole plate is provided with at least one transverse horizontal pivotal axis which is disposed in the region supporting the ball of the boot and about which the sole plate can bend only in the upward direction, that is to say about which it can flex to assume an upwardly concave but not convex shape as viewed when the sole plate is in position on a ski.

By means of the invention, therefore, the sole plate can adapt its shape at least approximately to the flexure of the ski.

In one advantageous construction, the sole plate is made in at least two parts which are hinged to one another. In this case, the or each pivotal axis is constituted by the hinge line or lines. In an alternative construction, at least the ball-supporting region of the sole plate is formed by a comparatively thin continuous flexible sheet to the underside of which there are secured a plurality of juxtaposed transverse members which are not directly interconnected.

In either form of the invention, provision may be made so that the safety ski-binding need not necessarily be used with a ski boot having a flexible sole. For this purpose at least one of the aforementioned sole depressors is outwardly displaceable lengthwise of the sole plate against spring force. Thus, if a boot with a relatively inflexible sole is used with the sole plate and the ski happens to flex to a curvature to which the sole plate then substantially adapts itself, the elongation of the chord formed by the sole of the boot is compensated by the resilient displacement of at least one of the sole depressors.

Further objects and features of the invention will become evident from the following description of two examples with reference to the accompanying diagrammatic drawings, wherein.

Figure 1:
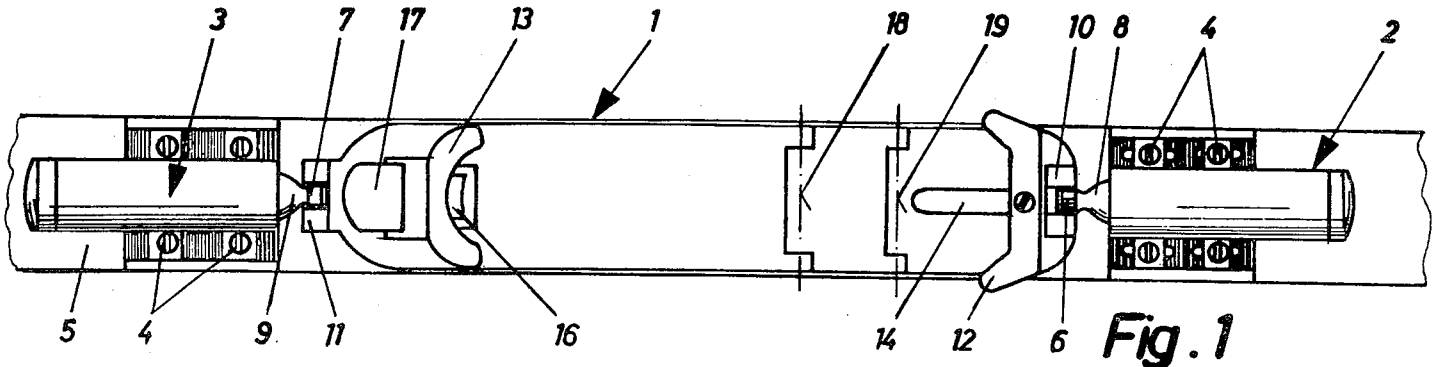
FIG. 1 is a plan view of a first embodiment of safety ski-binding.
Figure 2:
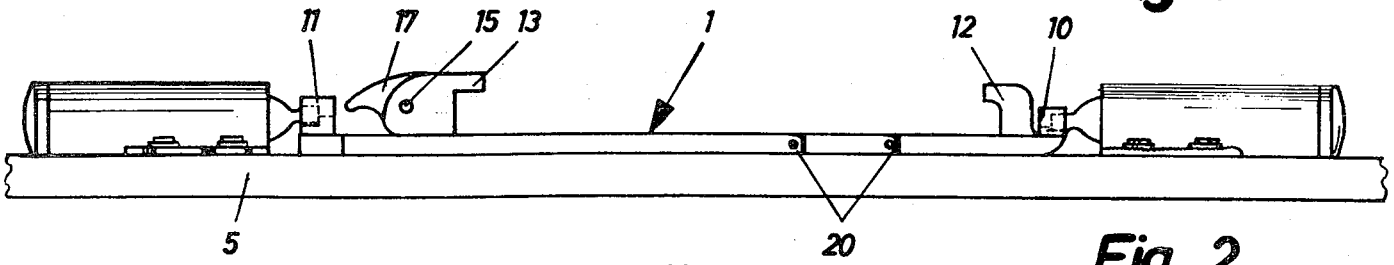
FIG. 2 is a side elevation of the FIG. 1 binding.

Referring to FIGS. 1 and 2, the safety ski-binding illustrated therein comprises an elongated sole plate 1 mounted on a ski 5 by mounting means 2 and 3 at the front and back of the sole plate, respectively. The front and back mounting means are secured to the ski by screws 4 and comprise a bolt 8 or 9 carrying a pin 6 or 7 engaging in a recess of a respective catch member 10 or 11 provided at the ends of the sole plate 1. Since the actual construction of the mounting means 2 and 3 for the sole plate does not constitute a part of the present invention, and since the construction is not critical, a more detailed description is regarded unnecessary but it may be mentioned that, to fulfil the safety function of the binding properly, it must be possible for the sole plate to move vertically and at least to both sides horizontally as well as upwardly at the back when a predetermined high strain is applied so that the plate becomes unlocked and is released from the ski.

At the front the sole plate 1 carries a sole depressor 12 and at the back a sole depressor 13. To enable the ski-binding to be adapted to boots of various lengths, the sole depressor 12 is adjustable lengthwise of the sole plate, for which purpose the latter is provided with a slot 14. The back sole depressor 13 is pivotable relatively to the sole plate 1 about a horizontal transverse shaft 15. Together with a pedal 16 and an opening handle 17, the rear sole depressor 13 forms a so-called step-in device so that the boot is retained on the sole plate except when it is to be deliberately released.

To achieve a certain amount of upward flexibility for the sole plate 1 in accordance with the present invention, the sole plate is divided at two positions in the ball region of the boot. Accordingly, the sole plate is made in three parts which are hinged to one another at 18 and 19. As evident from FIG. 2, abutments 20 are provided at the hinge positions to ensure that the two outer plate portions cannot be swung downwardly relatively to the central plate portion. In other words, the configuration assumed by the plate portions can only be upwardly concave so that the sole plate will adapt itself approximately to a corresponding flexure of the ski 5.

Figure 3:
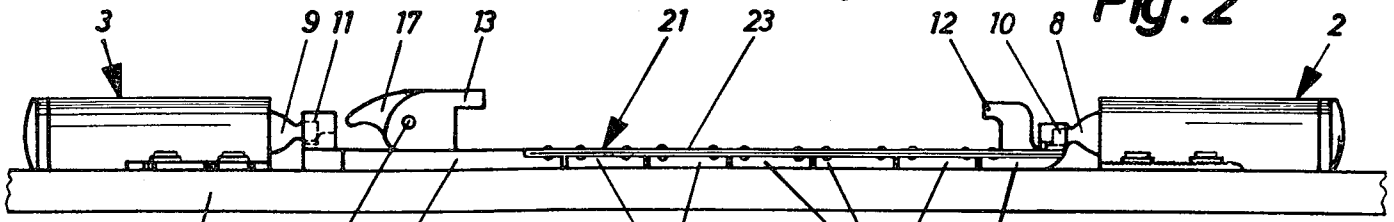
FIG. 3 is a view corresponding to FIG. 2 but showing a second embodiment of safety ski-binding.

The fundamental construction of the FIG. 3 embodiment of safety ski-binding is the same as for the embodiment of FIGS. 1 and 2 and consequently the same reference numerals have been used for the equivalent integers. The principal difference in the FIG. 3 construction is that the sole plate 21 is made in more than three parts. It consists of a relatively short rigid rear portion 22 to which a comparatively thin flexible layer or sheet 23 is secured such as by rivets. Riveted to the underside of this sheet 23 there are a plurality of rigid transverse members 24, 25. These transverse members are closely juxtaposed so that they prevent flexure of the sheet 23 to an upwardly convex shape. Since the transverse members 24, 25 are not directly interconnected, it is possible for the sheet 23 to flex to an upwardly concave shape. The sole plate 21 can therefore likewise adapt its shape to the upwardly concave flexure of the ski 5 occurring during use.

In the FIG. 3 embodiment the front sole depressor 12 is not longitudinally displaceable as in the case of FIGS. 1 and 2. Instead, adjustment to different sole lengths of ski boot is effected by longitudinal displacement of the rear sole depressor 13. In addition, the sole depressor 13 is displaceable to the left-hand side as viewed in FIG. 3 against the action of a spring. Such resilient outward displacement of the sole depressor is known per se and has therefore not been illustrated in detail. It permits the desired flexibility of the sole plate 21 to be obtained even if the boot supported thereon does not have a flexible sole because when the ski flexes the elongation of the chord formed by the sole of the boot is compensated by resilient displacement of the sole depressor 13.

I claim:

1. A safety ski-binding comprising an elongated sole plate adapted to be fitted on a ski to support a ski boot, front and rear sole depressors provided on the sole plate for retaining the boot thereon except when it is to be intentionally released, and mounting means for the sole plate effective to release the latter from the ski in a vertical and/or horizontal direction on the occurrence of overload, wherein the sole plate is provided with at least one transverse horizontal pivotal axis which is disposed in the region supporting the ball of the boot and about which the sole plate can bend only in the upward direction.

2. The binding of claim 1, wherein said sole plate is made in at least two parts which are hinged to one another.

3. The binding of claim 1, wherein at least the ball-supporting region of the sole plate comprises a continuous thin flexible sheet to the underside of which there are secured a plurality of juxtaposed transverse members.

4. The binding of claim 1, wherein at least one of the sole depressors is outwardly displaceable lengthwise of the sole plate against spring force.

* * * * *